US009074437B2

(12) United States Patent
Stingerie et al.

(10) Patent No.: US 9,074,437 B2
(45) Date of Patent: Jul. 7, 2015

(54) ACTUATION AND RELEASE TOOL FOR SUBTERRANEAN TOOLS

(75) Inventors: Jason C. Stingerie, Houston, TX (US); Louis M. Gambertoglio, The Woodlands, TX (US); David L. Nevels, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 346 days.

(21) Appl. No.: 13/490,851

(22) Filed: Jun. 7, 2012

(65) Prior Publication Data

US 2013/0327516 A1 Dec. 12, 2013

(51) Int. Cl.
*E21B 33/10* (2006.01)
*E21B 23/00* (2006.01)

(52) U.S. Cl.
CPC ..... *E21B 23/00* (2013.01)

(58) Field of Classification Search
USPC ..... 166/191, 332.1, 332.4, 208, 212
See application file for complete search history.

(56) References Cited

U.S. PATENT DOCUMENTS

| | | | | |
|---|---|---|---|---|
| 3,948,322 | A * | 4/1976 | Baker | 166/289 |
| 4,151,880 | A * | 5/1979 | Vann | 166/373 |
| 5,020,600 | A * | 6/1991 | Coronado | 166/387 |
| 5,146,992 | A * | 9/1992 | Baugh | 166/383 |
| 5,551,512 | A | 9/1996 | Smith | |
| 6,125,937 | A * | 10/2000 | Longbottom et al. | 166/313 |
| 6,152,224 | A * | 11/2000 | French | 166/250.08 |
| 6,966,368 | B2 * | 11/2005 | Farquhar | 166/128 |
| 7,066,264 | B2 * | 6/2006 | Bissonnette et al. | 166/305.1 |
| 7,681,654 | B1 * | 3/2010 | Cugnet | 166/387 |
| 7,686,090 | B2 | 3/2010 | Reimert et al. | |
| 7,766,088 | B2 | 8/2010 | Sessions et al. | |
| 7,849,925 | B2 | 12/2010 | Patel | |
| 8,267,178 | B1 * | 9/2012 | Sommers et al. | 166/334.4 |
| 2001/0041100 | A1 * | 11/2001 | McCabe et al. | 405/269 |
| 2002/0074134 | A1 * | 6/2002 | Cook et al. | 166/383 |
| 2002/0166665 | A1 * | 11/2002 | Vincent et al. | 166/291 |
| 2003/0056951 | A1 * | 3/2003 | Kaszuba | 166/250.01 |
| 2004/0035589 | A1 * | 2/2004 | Kilgore et al. | 166/383 |
| 2004/0154798 | A1 * | 8/2004 | Vincent et al. | 166/291 |
| 2005/0000693 | A1 * | 1/2005 | Ravensbergen et al. | 166/301 |
| 2005/0016737 | A1 * | 1/2005 | Kilgore et al. | 166/377 |
| 2007/0007014 | A1 * | 1/2007 | Sessions et al. | 166/374 |
| 2009/0014168 | A1 * | 1/2009 | Tips et al. | 166/73 |
| 2009/0107675 | A1 * | 4/2009 | Eriksen et al. | 166/285 |
| 2010/0116488 | A1 * | 5/2010 | Baskett et al. | 166/153 |
| 2010/0163253 | A1 * | 7/2010 | Caldwell et al. | 166/387 |
| 2010/0212910 | A1 | 8/2010 | James | |
| 2010/0319927 | A1 | 12/2010 | Yokley et al. | |
| 2011/0174491 | A1 * | 7/2011 | Ravensbergen et al. | 166/308.1 |
| 2011/0308817 | A1 * | 12/2011 | Ravensbergen | 166/382 |
| 2012/0097398 | A1 * | 4/2012 | Ravensbergen et al. | 166/308.1 |

(Continued)

*Primary Examiner* — Blake Michener
(74) *Attorney, Agent, or Firm* — Steve Rosenblatt

(57) ABSTRACT

An actuator for a subterranean tool is releasably retained by a collet. The actuation system features opposing actuation pistons with ports communicating to the tubing. The spaced ports are sequentially straddled for initial setting and a subsequent release using a predetermined applied pressure. The applied pressure overcomes the retaining force of the collet and actuates a one of two opposed pistons to set the tool, which is preferably a liner hanger. Upon shifting the actuation tool to communication to another port leading to an actuating piston pushing in another direction with applied pressure releases the tool and re-latches a retaining collet. The tool can be set, released and repositioned for another cycle in the same trip in the hole.

19 Claims, 2 Drawing Sheets

(56) References Cited

U.S. PATENT DOCUMENTS

2012/0111574 A1 5/2012 Desranleau et al.
2012/0160520 A1* 6/2012 Lumbye ..... 166/386
2012/0175133 A1* 7/2012 Nikiforuk ..... 166/386
2013/0092369 A1* 4/2013 Stingerie ..... 166/208
2013/0299200 A1* 11/2013 Hughes et al. ..... 166/387

* cited by examiner

ACTUATION AND RELEASE TOOL FOR SUBTERRANEAN TOOLS

FIELD OF THE INVENTION

The field of the invention is actuators for subterranean tools and more particularly those that are initially in pressure balance to tubing pressure through spaced ports leading to opposed pistons and more specifically where the access ports to tubing pressure can be sequentially exposed for unlocking, setting and releasing the tool such as a liner hanger.

BACKGROUND OF THE INVENTION

Hydraulic actuators in the past have been made insensitive to tubing pressure using opposed pistons that create opposing forces to any tubing pressure so that the net result is no movement of the actuator mechanism so that the tool is not set even if there are pressure surges in the tubing. To insure that there is no premature setting the sleeve to be moved to set the tool can be held with a shear pin that breaks under a predetermined net force. Tool actuation involves isolating an upper inlet to one of the pistons from a lower inlet to an opposing piston, such as with an object dropped on a seat in the tubing. This is followed with elevating the pressure to one of the pistons that has access to tubing pressure above the seated object so that one piston creates a net force in the setting direction for setting the tool. A retainer for the setting sleeve can be broken in the setting process as the tool is set with the actuator. This design is shown in schematic terms in U.S. Pat. No. 7,766,088. While this reference mentions in passing an application for unsetting a tool, the details provided focus on how to set and no details are provided as to how to unset with the described actuation tool.

U.S. Pat. No. 7,686,090 shows the use of a floating piston in a liner hanger actuation tool with a balance piston referenced to the annulus. US Publication 2010/0319927 shows the use of a ball seat that can be displaced with a seated ball on it into a larger diameter for release of the ball.

The present invention goes a step further by initial isolation of one actuating piston to set a tool such as a liner hanger and then isolation of an opposing piston to tubing pressure to reverse the movement of an actuation mechanism for release of the tool such as a liner hanger. Those skilled in the art will more readily appreciate various aspects of the invention from a review of the description of the preferred embodiment and the associated drawings while recognizing that the full scope of the invention is to be determined by the appended claims.

SUMMARY OF THE INVENTION

An actuator for a subterranean tool is releasably retained by a collet. The actuation system features opposing actuation pistons with ports communicating to the tubing. The spaced ports are sequentially straddled for initial setting and a subsequent release using a predetermined applied pressure. The applied pressure overcomes the retaining force of the collet and actuates a one of two opposed pistons to set the tool, which is preferably a liner hanger. Upon shifting the actuation tool to communication to another port leading to an actuating piston pushing in another direction with applied pressure releases the tool and re-latches a retaining collet. The tool can be set, released and repositioned for another cycle in the same trip in the hole.

DETAILED DESCRIPTION OF THE PREFERRED EMBODIMENT

Figure 5:
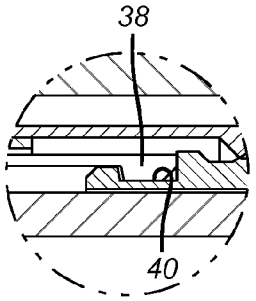
FIG. 5 is an enlarged view of the detail in the circle of FIG. 1.
Figure 1:
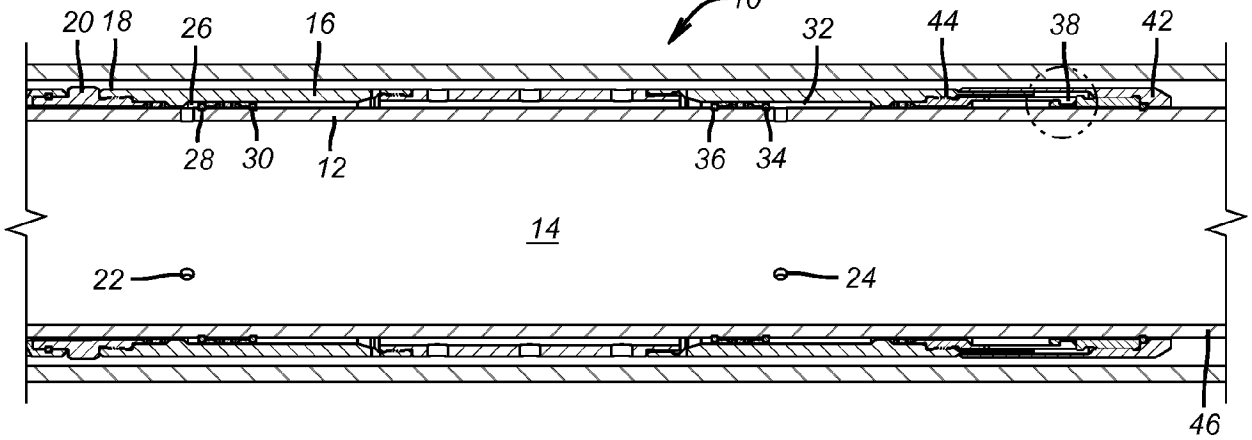
FIG. 1 shows the actuator tool in the run in position.

FIG. 1 shows the actuation tool 10 that has a mandrel 12 that defines a tubing passage 14 that extends to a well surface through a tubular string that is not shown. An actuating sleeve 16 is connected at an upper end 18 to a schematically represented tool 20 which preferably is a liner hanger but it can be a variety of other tools. The sleeve 16 is moved axially in opposed directions to set and release the tool 20.

For running in with ports 22 and 24 accessible in passage 14 there will be no movement of sleeve 16 because the piston area in chamber 26 defined by seals 28 and 30 is equal to the piston area in chamber 32 defined by seals 34 and 36 and opposing in direction. The volume in chambers 26 and 32 varies as the sleeve 16 is forced to move axially. Before any axial movement of sleeve 16 can occur, to set the tool 20, enough pressure has to be applied to port 22 to make collet 38 jump out of groove 40. Groove 40 is retained to mandrel 12 with ring 42. Collet 38 is secured at thread 44 to the sleeve 16. The purpose of the collet 38 being in groove 40 is to allow a predetermined force to build up through ports 22 before there is sleeve 16 movement. Additionally, during run in, if the sleeve 16 is bumped on a surrounding tubular or connection in the wellbore then the collet 38 in groove 40 will resist sliding movement and pre-setting of tool 20 due to the engagement of collets 38 in groove 40.

Figure 2:
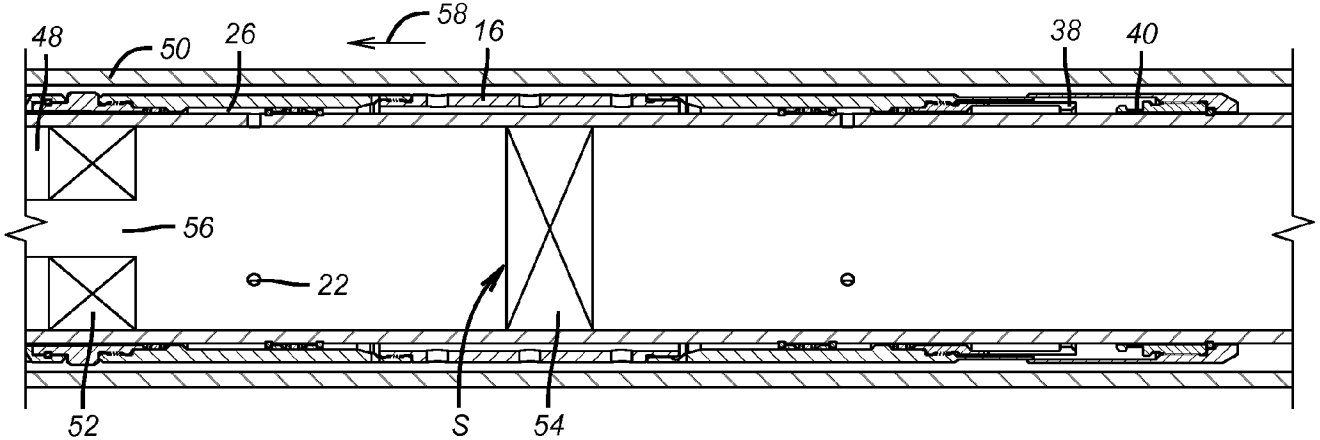
FIG. 2 shows an upper port in the actuator tool isolated with an internal straddle device so that pressure applied to the isolated port will set the downhole tool that is operably connected to the actuator tool.
Figure 3:
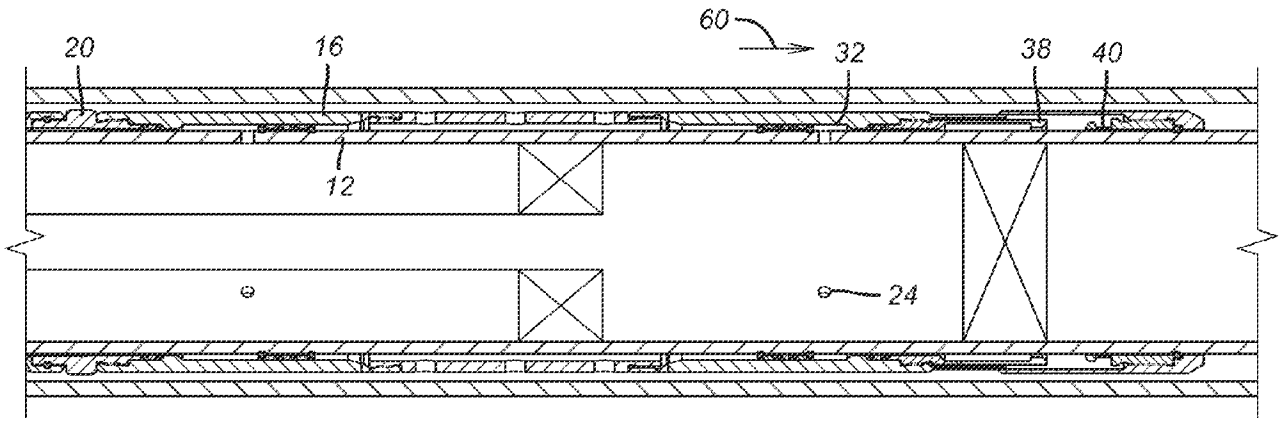
FIG. 3 is the view of FIG. 2 with the straddle device shifted to straddle another isolated port so that applied pressure will cause the downhole tool to release.

FIG. 2 shows a running and actuation tool that is associated with the mandrel 12 and the string that is not shown and attached to the lower end 46. The running and actuation tool has several features that are schematically illustrated. There is a gripping device shown schematically as 48 that grabs the mandrel 12 and selectively releases when the mandrel 12 becomes independently supported to the surrounding tubular 50 or some other way supported in the wellbore. At the same time the gripping device 48 allows for run in and release of the mandrel 12 when there is support such as by actuation of a tool 20 that in the preferred embodiment is a liner hanger. When running in, spaced seals 52 and 54 can be located in a straddle about openings 22 and 24 or both ports 22 and 24 can be open to the passage 14. Seals 52 and 54 are an isolation assembly and can be a variety of designs that are either run in with a sealing position or that need to be actuated when in the proper location. These seals can be cup seals, inflatable, ball seats S that accept balls or other styles that allow selective straddling of the ports 22 or 24. Application of pressure through passage 56 goes into ports 22 but that same pressure is isolated from ports 24 due to seal 54. As pressure is applied the collets 38 jump out of groove 40 when a predetermined pressure is applied in chamber 26 which then starts to increase in volume as the collets 38 jump groove 40. If the tool 20 is a liner hanger, then movement of sleeve 16 in the direction of arrow 58 will set the liner hanger and support the mandrel 12. The running tool gripping device 48 is released from the mandrel 12 in conjunction with the shifting of the sleeve 16. At this point the running and straddle tool assembly can be moved relative to the mandrel 12 to assume the FIG. 3 position from which it is possible to urge the sleeve 16 in the direction of arrow 60 to release the tool 20 or to reverse its previous motion, depending on the nature of the tool. Such reverse movement will bring collets 38 back to groove 40 and release the slips of the liner hanger (not shown) so that the mandrel 12 can be moved within the borehole or pulled out of the hole. Such movement in the direction of arrow 60 must also be preceded with regaining a grip on the mandrel 12 as the tool 20 such as a hanger is released. In FIG. 3 the openings 24 are straddled so that pressure applied to chamber 32 moves the sleeve 16 in the direction of arrow 60.

Figure 4:
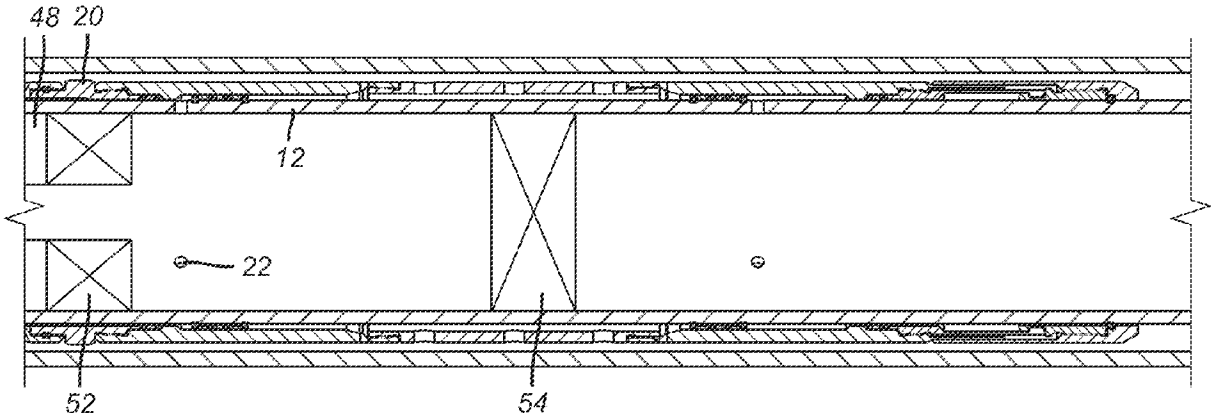
FIG. 4 shows the released downhole tool in position for being pulled out of the hole or relocated for another setting.

In FIG. 4 the mandrel 12 is supported by the grip 48 up above so that the liner supported by mandrel 12 will not drop if the liner hanger or other tool 20 is released. In essence, after releasing the hanger 20 while gripping the mandrel 12 with the seals straddling ports 24 the gripper 48 is engaged to the mandrel 12. If the mandrel 12 is to be pulled out of the hole then an upward force is applied to the running tool that now supports the mandrel 12 in the FIG. 3 position and the string and mandrel 12 with the tool 20 come out of the hole as an assembly.

On the other hand if after a release of tool 20 in FIG. 3 it is desired to reposition the mandrel 12 with the tool 20 in another well location without coming out of the hole then there needs to be an ability to retain support for mandrel 12 while repositioning seals 52 and 54 to again straddle ports 22 so that the tool 20 can be reset again before the gripper 48 releases the mandrel 12. This repositioning of the seals 52 and 54 can be done with a telescoping member responsive to fluid pressure or any other method that can then draw up the seals 52 and 54 to the FIG. 4 position and the process can be repeated.

Seal 54 can be a packer that can be set mechanically, hydraulically or by inflation to name a few options. Alternatively, seal 54 can be a ball seat that permits circulation or reverse circulation as long as there is no seated ball. To set the tool a ball can be dropped to the ball seat and pressure built in the FIG. 2 position for setting the tool 20. The ball can then be extruded through the seat such that a bigger ball can land on the same seat when the position of FIG. 3 is obtained so that the tool 20 can be released in the manner previously described. The same ball seat can accept many balls of increasing size, or can be a stack of different size ball seats, to allow the pressure cycling to be repeated several times for subsequent setting and releases of the tool 20 in different wellbore locations in the same trip. Such a design is well known in the art.

The present invention allows setting and releasing a tool multiple times in a single rip with a feature of making the setting sleeve 16 insensitive to tubing pressure or mechanical shocks from a surrounding tubular when running in. The grip and straddle tool allows setting a tool such as a liner hanger while releasing the grip of the mandrel. The mandrel can be gripped again when it is desired to release a tool such as a liner hanger by straddling different ports to reverse the movement of the actuating sleeve while at the same time gripping the mandrel so as to retain a liner string once the hanger releases. At this point the hanger and liner attached to it can be pulled out of the hole. Alternatively, while retaining the grip obtained, to initiate the release, the straddle seals can be repositioned by use of a telescoping member, among other techniques, to locate the seals 52 and 54 back over ports 22 and repeat the cycle without coming out of the hole.

The above description is illustrative of the preferred embodiment and many modifications may be made by those skilled in the art without departing from the invention whose scope is to be determined from the literal and equivalent scope of the claims below:

We claim:

1. An actuation assembly for operation of a subterranean tool into multiple positions, comprising:

a mandrel having at least one first wall port and at least one second wall port;

an actuation sleeve spanning both ports with at least one seal between said mandrel and said actuation sleeve to define spaced apart first and second variable volume chambers, whereupon pressure in said first chamber moves said actuation sleeve in a first direction and pressure in said second chamber moves said actuation sleeve in a second direction;

an isolation assembly said isolation assembly relatively movable in a passage of said mandrel to said wall ports to selectively isolate said first and said second wall ports at different times for fluid pressure deliver from uphole delivered to said port being isolated for selective opposed actuation sleeve movements to put the subterranean tool in multiple positions.

2. The assembly of claim 1, wherein:

said actuation sleeve is initially retained in a run in position against shock loads during running in.

3. The assembly of claim 2, wherein:

said run in position leaves both said first and second wall ports in fluid communication with said passage in said mandrel.

4. The assembly of claim 2, wherein:

movement of said actuation sleeve in said first direction responsive to said pressure applied only in said first chamber releases a resettable retainer after a predetermined force resulting from said applied pressure to said first chamber is applied to said actuation sleeve.

5. The assembly of claim 4, wherein:

movement of said actuation sleeve in said second direction responsive to said pressure in said second chamber rearms said resettable retainer after a predetermined force from said applied pressure to said second chamber is applied to said actuation sleeve.

6. The assembly of claim 5, wherein:

said resettable retainer comprises at least one collet selectively engaging a groove with one of said collect and said groove mounted on said mandrel and the other of said collet and said groove mounted on said actuation sleeve.

7. The assembly of claim 1, wherein:

said isolation assembly further comprises spaced apart sealing assemblies.

8. The assembly of claim 7, wherein:

said sealing assemblies move in tandem.

9. The assembly of claim 7, wherein:

said sealing assemblies selectively straddle said first or said second wall port in a single trip and at least one time during said single trip.

10. The assembly of claim 7, wherein:

said isolation assembly further comprising a gripping assembly for selective support of said mandrel.

11. The assembly of claim 10, wherein:

said gripping assembly being releasable from gripping said mandrel and resettable to grip said mandrel again.

12. The assembly of claim 1, wherein:

said actuation sleeve sets a liner hanger when moved in said first direction and releases said liner hanger when said actuation sleeve moves in said second direction.

13. The assembly of claim 12, wherein:

said liner hanger can be set and released multiple times in a single trip with movements of said actuation sleeve.

14. The assembly of claim 13, wherein:

said isolation assembly further comprises spaced apart sealing assemblies.

15. The assembly of claim 14, wherein:

at least one of said seal assemblies comprises a seat movable in said passage with at least one object landing and sealing said passage when landed on said seat.

16. The assembly of claim 15, wherein:

multiple objects of different sizes sequentially land on said seat for multiple obstructions of said passage.

17. The assembly of claim 13, wherein:

said sealing assemblies move in tandem.

18. The assembly of claim 13, wherein:

said sealing assemblies selectively straddle said first or said second wall port in a single trip and at least one time during said single trip.

19. The assembly of claim 13, wherein:

said isolation assembly further comprising a gripping assembly for selective support of said mandrel.

* * * * *